US010052869B2

(12) United States Patent
Shimazoe et al.

(10) Patent No.: US 10,052,869 B2
(45) Date of Patent: Aug. 21, 2018

(54) INKJET HEAD, INKJET HEAD MODULE, AND INKJET PRINTER

(71) Applicant: Konica Minolta, Inc., Tokyo (JP)

(72) Inventors: Masanori Shimazoe, Hino (JP); Yasuo Nishi, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/505,990

(22) PCT Filed: Sep. 18, 2015

(86) PCT No.: PCT/JP2015/076620
§ 371 (c)(1),
(2) Date: Feb. 23, 2017

(87) PCT Pub. No.: WO2016/043303
PCT Pub. Date: Mar. 24, 2016

(65) Prior Publication Data

US 2017/0274653 A1 Sep. 28, 2017

(30) Foreign Application Priority Data

Sep. 19, 2014 (JP) ..... 2014-190840

(51) Int. Cl.
*B41J 2/14* (2006.01)
*B41J 2/175* (2006.01)
*B41J 2/475* (2006.01)

(52) U.S. Cl.
CPC ..... *B41J 2/14064* (2013.01); *B41J 2/1404* (2013.01); *B41J 2/14072* (2013.01);
(Continued)

(58) Field of Classification Search
CPC .. B41J 2/14064; B41J 2/14072; B41J 2/1404; B41J 2/045; B41J 2/01; B41J 2/4753; B41J 2002/14185
See application file for complete search history.

(56) References Cited

U.S. PATENT DOCUMENTS

2004/0104954 A1 6/2004 Ito et al.
2005/0280678 A1 12/2005 Bibl et al.
(Continued)

FOREIGN PATENT DOCUMENTS

EP 2 657 030 A1 10/2013
JP H10309801 A 11/1998
(Continued)

OTHER PUBLICATIONS

Office Action dated Aug. 31, 2017 from the corresponding Chinese Patent Application No. 201580050420.3 and English translation.
(Continued)

*Primary Examiner* — Kristal Feggins
(74) *Attorney, Agent, or Firm* — Lucas & Mercanti, LLP

(57) ABSTRACT

An inkjet head includes a head chip and an ink chamber. The head chip has a nozzle substrate provided with nozzles which discharge ink. The ink chamber is located over the head chip. In the ink chamber, the ink to be supplied to the nozzles is stored. The inkjet head is mounted on a mounting member. Between the nozzle substrate and the ink chamber, the inkjet head has a position reference substrate provided with butting parts. The butting parts are butted against the mounting member to position the inkjet head when the inkjet head is mounted on the mounting member.

11 Claims, 6 Drawing Sheets

(52) U.S. Cl.
CPC ..... *B41J 2/1752* (2013.01); *B41J 2/4753* (2013.01); *B41J 2002/14185* (2013.01)

(56) References Cited

U.S. PATENT DOCUMENTS

| | | | |
|---|---|---|---|
| 2010/0002051 | A1 | 1/2010 | Yoshimura |
| 2013/0021412 | A1 | 1/2013 | Nishimura et al. |

FOREIGN PATENT DOCUMENTS

| | | | |
|---|---|---|---|
| JP | 2006218671 | A | 8/2006 |
| JP | 2006-231802 | A | 9/2006 |
| JP | 2008-296518 | A | 12/2008 |
| JP | 2010030228 | A | 2/2010 |
| JP | 2011056926 | A | 3/2011 |
| JP | 2011062827 | A | 3/2011 |
| JP | 2012126029 | A | 7/2012 |

OTHER PUBLICATIONS

IPRP dated Mar. 21, 2017 from the corresponding International Application No. PCT/JP2015/076620; Total of 9 pages.
International Search Report dated Oct. 27, 2015 for PCT/JP2015/076620 and English translation.
Extended European Search Report dated Apr. 5, 2018 from corresponding European Application No. 15841984.6.
Notification of Reasons for Refusal dated Jun. 5, 2018 from the corresponding Japanese Patent Application No. JP 2016-548960 and English translation.

INKJET HEAD, INKJET HEAD MODULE, AND INKJET PRINTER

CROSS REFERENCE TO RELATED APPLICATION

This Application is a 371 of PCT/JP2015/076620 filed on Sep. 18, 2015, which, in turn, claimed the priority of Japanese Patent Application No. JP 2014-190840 filed on Sep. 19, 2014, both applications are incorporated herein by reference.

TECHNICAL FIELD

The present invention relates to an inkjet head, an inkjet head module and an inkjet printer.

BACKGROUND ART

There has been known an inkjet printer which forms images on recording media by discharging ink from nozzles disposed in an inkjet head(s).

These days, with accuracy enhancement of images formed by an inkjet printer, nozzles disposed in inkjet heads are densely arranged. If positions of such inkjet heads with respect to a mounting member(s) which supports the inkjet heads are shifted, formed images have lines and/or become blocky. These reduce image quality. It is, then, required to position nozzles disposed in inkjet heads with respect to recording media with a high degree of accuracy.

Then, for example, there is disclosed a method of inserting reference pins serving as references for positioning each inkjet head into through holes made in a first attaching plate, a second attaching plate and the inkjet head, and fixing the inkjet heads to amounting plate (frame) with the reference pins, thereby positioning nozzles with a high degree of accuracy (Patent Document 1).

Further, for example, there is disclosed a method of disposing intermediate supporting members between each inkjet head and a mounting member, and fixing the intermediate supporting members to the inkjet head and the mounting member (supporting substrate) with UV adhesive, thereby positioning nozzles with a high degree of accuracy (Patent Document 2).

RELATED ART DOCUMENTS

Patent Documents

Patent Document 1: Japanese Patent Application Publication No. 2010-30228

Patent Document 2: Japanese Patent Application Publication No. H10-309801

SUMMARY OF THE INVENTION

Problems to be Solved by the Invention

However, in the case of Patent Document 1, it is necessary to perform mechanical positioning twice; one is positioning performed when the first attaching plate and the second attaching plate are attached to the inkjet head, and the other is positioning performed when the reference pins are inserted to fix the inkjet head to the mounting plate (frame). Hence, the accuracy enhancement is difficult.

Further, in the case of Patent Document 2, although mechanical positioning is one time, because an adhesive is used for the above-described fixing, the accuracy enhancement is difficult due to errors in thickness of the adhesive layer, and also because the inkjet heads cannot be replaced in a unit of an inkjet head once fixed to the mounting member with the adhesive, maintainability is low.

The present invention has been conceived in view of these problems, and objects of the present invention include providing an inkjet head, an inkjet head module and an inkjet printer with each of which nozzles can be positioned with respect to a mounting member with a high degree of accuracy, and an inkjet head can be installed and replaced with another by simple operation and maintainability is excellent accordingly.

Means for Solving the Problems

In order to achieve the above object(s) or the like, the present invention stated in claim 1 is an inkjet head including: a head chip having a nozzle substrate provided with nozzles which discharge ink; and an ink chamber which is located over the head chip and in which the ink to be supplied to the nozzles is stored, wherein the inkjet head is mounted on a mounting member, and between the nozzle substrate and the ink chamber, the inkjet head has a position reference substrate provided with butting parts which are butted against the mounting member to position the inkjet head when the inkjet head is mounted on the mounting member.

The present invention stated in claim 2 is the inkjet head according to claim 1, wherein the position reference substrate is a supporting substrate which supports the head chip and the ink chamber.

The present invention stated in claim 3 is the inkjet head according to claim 1, wherein the head chip is constituted of substrates being stacked, and at least one substrate among the substrates constitutes the position reference substrate.

The present invention stated in claim 4 is the inkjet head according to any one of claims 1 to 3, wherein the head chip and the position reference substrate each have a coefficient of linear expansion of $1.2\times10^{-6}$ [/° C.] or more and $8.5\times10^{-6}$ [/° C.] or less.

The present invention stated in claim 5 is the inkjet head according to any one of claims 1 to 4, wherein the position reference substrate is formed of 42 alloy.

The present invention stated in claim. 6 is the inkjet head according to any one of claims 1 to 5, wherein the head chip and the position reference substrate have alignment marks, and the head chip and the position reference substrate are stacked such that the alignment marks are superposed.

The present invention stated in claim 7 is an inkjet head module including: the inkjet head according to any one of claims 1 to 6; and the mounting member which has an opening part and on which the head chip is mounted such that the nozzles are exposed from the opening part to face a recording medium, wherein the butting parts are fixed by being butted against butted parts with which the mounting member is provided.

The present invention stated in claim 8 is the inkjet head module according to claim 7, wherein opening parts, each being the opening part, are arranged one dimensionally or two dimensionally, and inkjet heads, each being the inkjet head, are arranged to correspond to the opening parts.

The present invention stated in claim 9 is an inkjet head module including: the inkjet head according to claim. 2; and the mounting member which has an opening part and on which the head chip is mounted such that the nozzles are exposed from the opening part to face a recording medium, wherein the butting parts are fixed by being butted against butted parts with which the mounting member is provided, opening parts, each being the opening part, are arranged one dimensionally or two dimensionally, inkjet heads, each being the inkjet head, are arranged to correspond to the opening parts, and head chips, each being the head chip, of the inkjet heads are supported by the supporting substrate being shared.

The present invention stated in claim 10 is an inkjet printer including the inkjet head module according to any one of claims 7 to 9.

The present invention stated in claim 11 is the inkjet printer according to claim 10, including a biasing mechanism which, in order that the butting parts are butted, biases the butting parts toward a direction in which the butting parts are pressed.

Advantageous Effects of the Invention

According to the present invention, nozzles can be positioned with respect to a mounting member with a high degree of accuracy, and also an inkjet head can be installed and replaced with another by simple operation.

EMBODIMENTS FOR CARRYING OUT THE INVENTION

Hereinafter, preferred embodiment(s) of the present invention are explained with reference to the drawings. However, the scope of the present invention is not limited to the illustrated examples. Further, in the following explanation, the same reference number(s) is given to components having the same function and configuration, and explanation is not repeated.

Hereinafter, explanation is made, as an example, about an embodiment adopting a one-pass drawing system using line heads to perform drawing by only conveying recording media. However, the present invention can adopt any appropriate drawing system, such as a scan system or a drum system.

[Configuration of Inkjet Printer]

Figure 1:
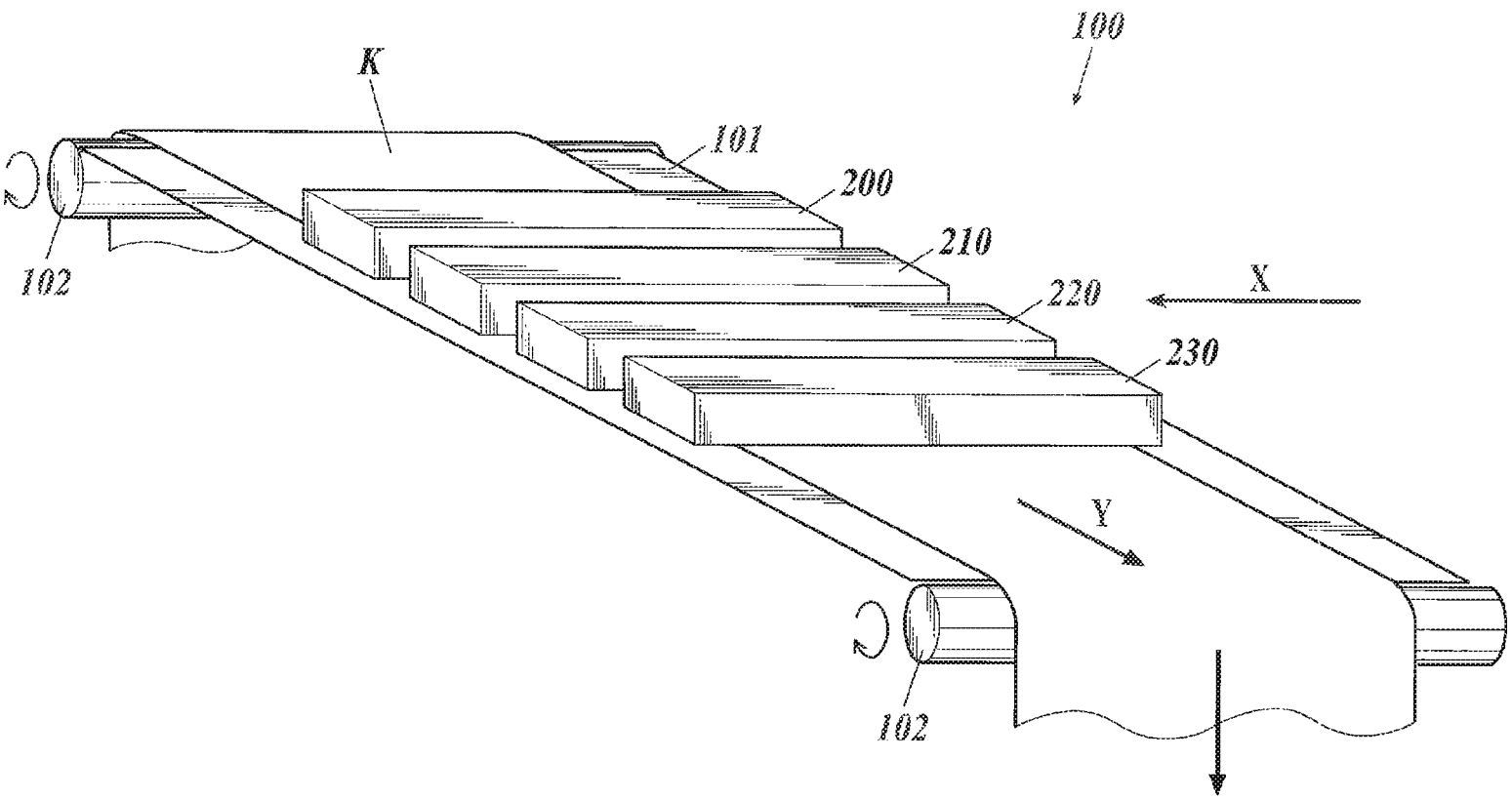
FIG. 1 is a perspective view schematically showing the configuration of an inkjet printer of the present invention.

An inkjet printer 100 has a platen 101 which supports a recording medium K as shown in FIG. 1. In front of and behind the platen 101, conveying rollers 102 for conveying the recording medium K are disposed. When the conveying rollers 102 are driven, the recording medium K is conveyed forward from behind (Y direction) in the state of being supported by the platen 101.

Above the platen 101, long inkjet head modules 200, 210, 220, 230 which extend in a direction (X direction) at right angles to the conveying direction are disposed parallel from the upstream side to the downstream side in the conveying direction. The inkjet head modules 200, 210, 220, 230 each contain at least one inkjet head 1 described below, and discharge inks of cyan (C), magenta (M), yellow (Y) and black (K) to the recording medium K, for example.

[Configuration of Inkjet Head]

The configuration of the inkjet head 1 is explained with reference to FIG. 2 and FIG. 3. In the following explanation, a plane where nozzles N are disposed is regarded as XY plane and the plane is the bottom of a head chip 2, and directions along the plane and at right angles to each other are regarded as X direction and Y direction. In addition, a direction at right angles to the XY plane is regarded as Z direction (up-down direction).

Figure 2:
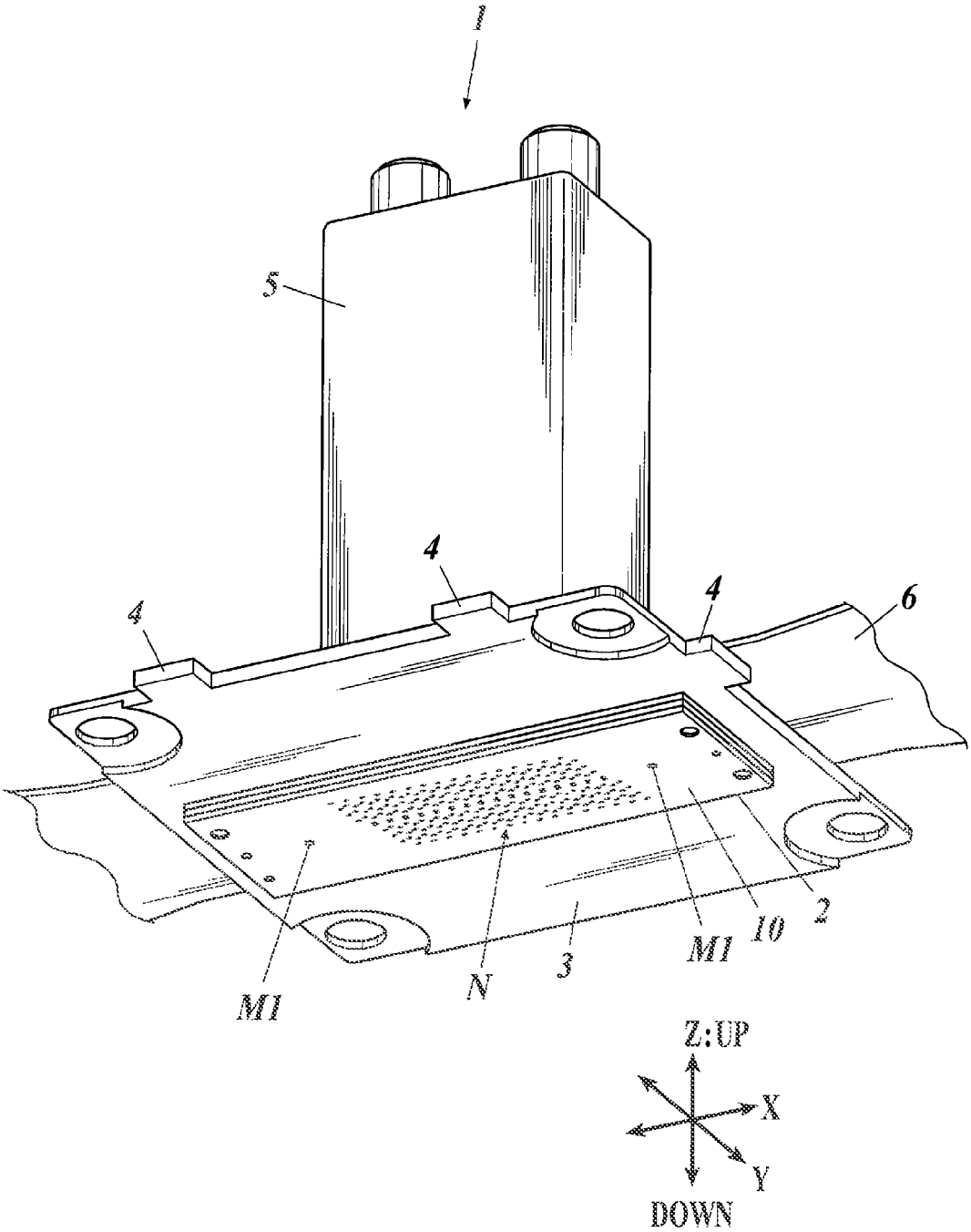
FIG. 2 is a perspective view of an inkjet head.

As shown in FIG. 2, the bottom layer of the inkjet head 1 is provided with the head chip 2 constituted of substrates being stacked. The substrates include a nozzle substrate 10 where the nozzles N, which discharge ink, are arranged. On the upper surface of the head chip 2, an ink chamber 5 which supplies ink to the nozzles N is disposed, and the head chip 2 and the ink chamber 5 are supported by a supporting substrate 3.

The supporting substrate 3 functions as a position reference substrate too. The contour part of the XY plane of the supporting substrate 3 is provided with butting parts 4 at three points in total, two points along the X direction and one point along the Y direction. The supporting substrate 3 has a supply channel(s) to supply ink from the ink chamber 5 to the head chip 2. When the head chip 2 and the supporting substrate 3 are joined, they are accurately aligned such that an inflow port(s) of the head chip 2, into which ink supplied from the supporting substrate 3 flows, and the supply channel of the supporting substrate 3 communicate with each other, and then joined. Accordingly, the relative position of the supporting substrate 3 with respect to the nozzles N becomes highly accurate. Thus, the supporting substrate 3 can be preferably used as the position reference substrate.

The butting parts 4 can accurately place the supporting substrate 3 at a predetermined position by being butted against butted parts 202 (FIG. 5) with which a mounting member 201 (frame) of the inkjet head module 200 is provided. Further, because the butting parts 4 are fixed to the butted parts 202 at three points, position shift of the butting parts 4 hardly occurs after the butting parts 4 are butted against and fixed to the butted parts 202.

Shape of the butting parts 4 can be appropriately selected as long as the butting parts 4 can be stably butted against the butted parts. For example, as shown in FIG. 2, the butting parts 4 to be used may be rectangular when viewed from the Z direction. In addition, material of the butting parts 4 can be appropriately selected as long as it is a material with which the butting parts 4 do not easily deteriorate by being butted against the butted parts. For example, various types of metal can be used therefor.

Figure 3:
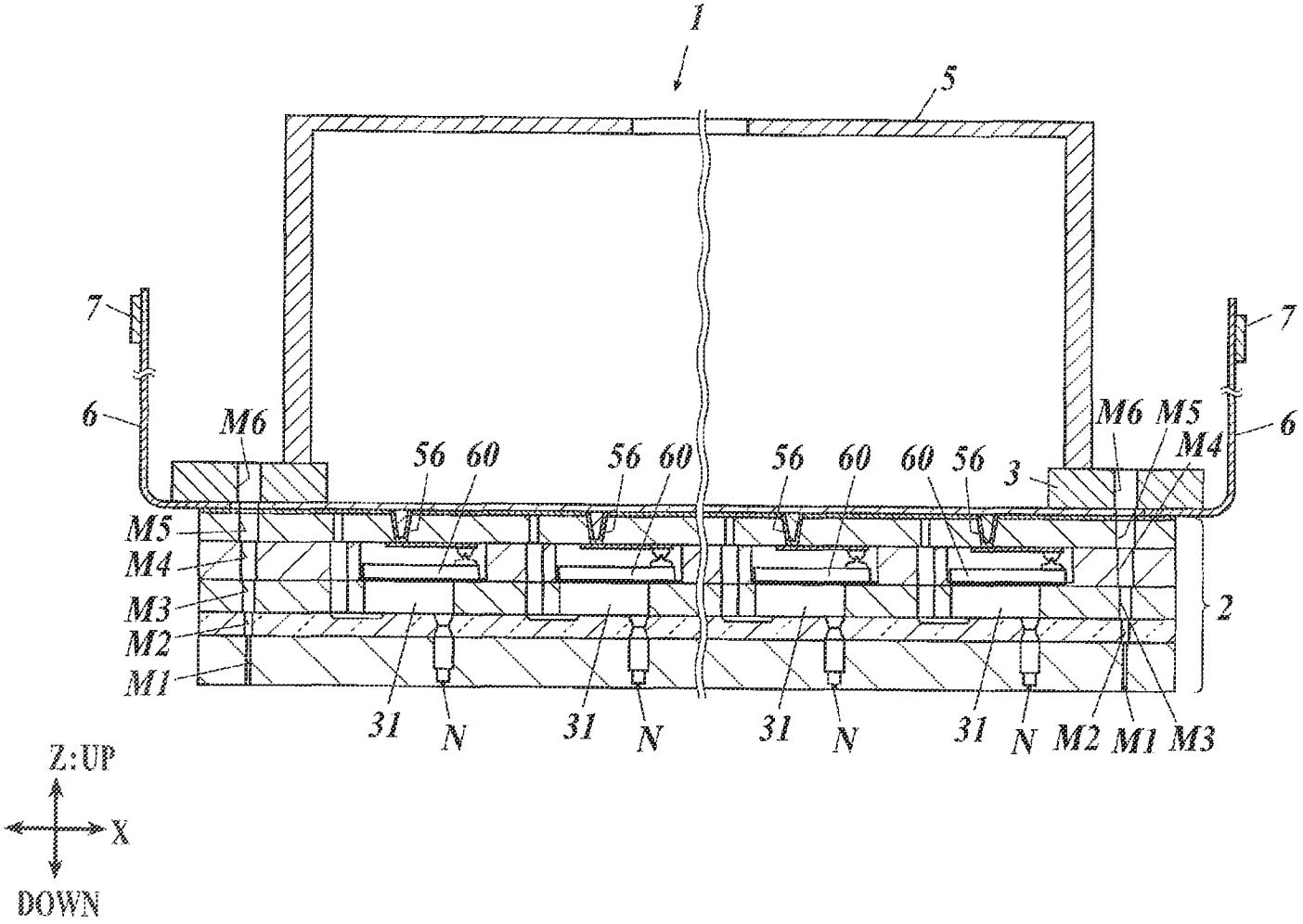
FIG. 3 is a cross-sectional view of the main part of the inkjet head.

Further, as shown in FIG. 3, the inkjet head 1 discharges ink droplets from the nozzles N by supplying ink from the ink chamber 5 to pressure chambers 31 disposed in the head chip 2 for the respective nozzles N, and pressurizing the ink with actuators 60.

In the upper part of the head chip 2, there is provided a wiring via through electrodes 56 for electric supply to the actuators 60, and the wiring is connected to connecting substrates 6 at both ends of the upper part of the head chip 2 in the X direction. Electricity is supplied to the actuators 60 from drive parts 7 connected to the connecting substrates 6.

In the above explanation, the relative position of the supporting substrate 3 with respect to the nozzles N becomes highly accurate by accurately aligning the ink supply channel of the supporting substrate 3 with the ink inflow port of the head chip 2. Alternatively, the supporting substrate 3 and the head chip 2 may be provided with alignment marks for their accurate alignment if the supporting substrate 3 is provided with no ink supply channel. Still alternatively, both (i) the ink supply channel and the ink inflow port and (ii) the alignment marks may be provided for the accurate alignment.

Hereinafter, explanation is made about a case where alignment marks are also provided for the accurate alignment.

As shown in FIG. 3, the head chip 2 and the supporting substrate 3 are provided with alignment marks M1 to M6 near the both ends in the X direction. These alignment marks M1 to M6 are constituted of through holes passing to and through the nozzle substrate 10 in the Z direction.

The alignment marks M1 to M6 are the through holes which gradually become larger layer by layer from the lower side of the layers of the head chip 2 and the supporting substrate 3 in the X direction, and used for stacking the substrates of the head chip 2 and the supporting substrate 3. More specifically, when the substrates are stacked, they are stacked with fine position adjustment such that the alignment marks M1 to M6 are superposed, and accordingly the substrates are aligned with one another with a high degree of accuracy. By stacking the substrates with a high degree of accuracy, the relative position of the butting parts 4, with which the supporting substrate 3 (position reference substrate) is provided, with respect to the nozzles N become highly accurate.

[Configurations of Head Chip and Supporting Substrate]

Figure 4:
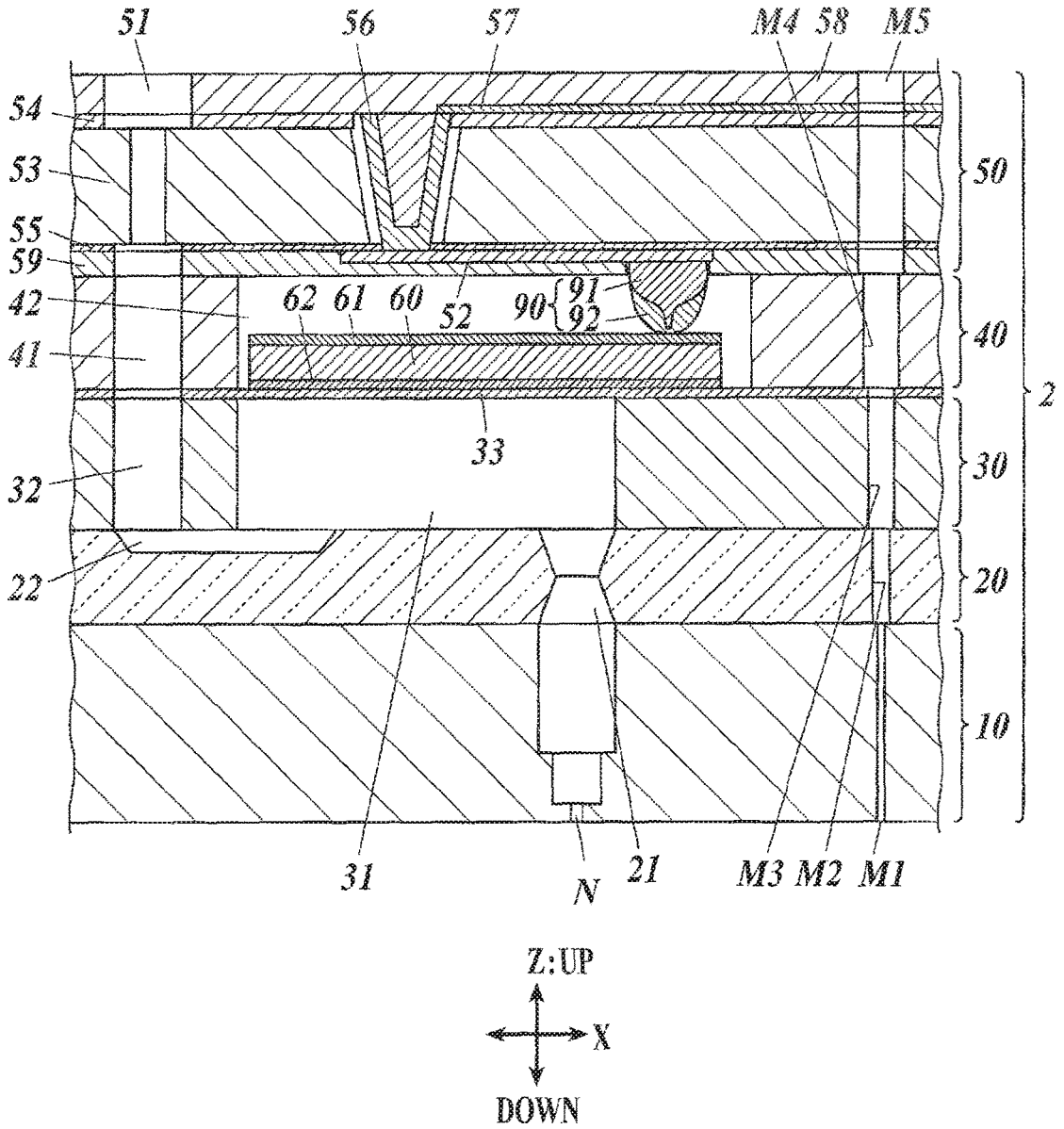
FIG. 4 is a cross-sectional view of a head chip of the inkjet head.

The configuration of the head chip 2 is explained with reference to FIG. 4, which is a cross-sectional view of its main part. In order to simplify the explanation, FIG. 4 shows the configuration to discharge ink from, among the nozzles N, one nozzle N adjacent to the above-described alignment mark M1.

The head chip 2 is constituted of the nozzle substrate 10, a bonding substrate 20, a pressure chamber substrate 30, a spacer substrate 40 and a wiring substrate 50 being stacked in the order named from the lower side in the Z direction. As described above, the ink chamber 5 is disposed over the head chip 2, and the head chip 2 and the ink chamber 5 are supported by the supporting substrate 3.

The substrates of the head chip 2 and the supporting substrate 3 are formed by selecting, as their base materials, only materials having a coefficient of linear expansion of $1.2\times10^{-6}$ [/° C.] or more and $8.5\times10^{-6}$ [/° C.] or less. More specifically, they are formed of, for example, silicon, 42 alloy or glass.

For the nozzle substrate 10, it is preferable to use silicon, which has excellent processability, in order to position the nozzles, which are densely arranged, with a high degree of accuracy. Further, for the other substrates, it is preferable to use 42 alloy, which has high ink resistance, strength and excellent heat resistance.

As described above, the head chip 2 and the supporting substrate 3 are formed of only the base materials having similar coefficients of linear expansion. This contributes to hardly causing position shift of the substrates of the layers even when, for example, heated ink is used.

Next, the substrates of the respective layers of the head chip 2 are explained.

The nozzle substrate 10 is a substrate located at the bottom layer, and as described above, made of silicon so that the nozzles N, which are densely arranged, are formed with a high degree of accuracy.

The bonding substrate 20 is joined to the upper surface of the nozzle substrate 10, and provided in order to provide a conduit(s) 21 between the nozzle substrate 10 and the ink chamber substrate 30. The conduit 21 adjusts the shape of an ink flow channel, for example, by being shaped to narrow the diameter of the path which ink passes through, and thereby adjusts kinetic energy to be applied to ink in relation to ink discharge.

The pressure chamber substrate 30 is joined to the upper surface of the bonding substrate 20, and has the pressure chamber 31 which communicates with the nozzle N via the conduit 21 of the bonding substrate 20. To the upper surface of the pressure chamber substrate 30, an oscillation plate 33 is joined, and on the oscillation plate 33, the actuator 60 is disposed. The actuator 60 touches the oscillation plate 33, thereby being disposed thereon.

The spacer substrate 40 is joined to the upper surface of the oscillation plate 33, and secures space corresponding to the actuator 60 and a connecting part 90 in width along the Z direction. The spacer substrate 40 has an opening part(s) 42 corresponding to a disposal location of the actuator 60 on the upper surface side of the oscillation plate 33. The opening part 42 is formed, over the pressure chamber 31, to pass through the spacer substrate 40 in the Z direction.

The wiring substrate 50 includes, for example: a plate-shaped interposer 53 as the main part of the wiring substrate 50; insulating layers 54 and 55 respectively covering the upper surface and the lower surface of the interposer 53; a through electrode(s) 56 disposed in a through hole(s) passing through the insulating layer 54, the interposer 53 and the insulating layer 55; a wiring 57 disposed on the upper surface of the insulating layer 54 and electrically connected to the upper-side end of the through electrode 56; an insulating layer 58 covering the upper surface of the wiring 57 and the upper surface of a portion of the insulating layer 54, the portion where the wiring 57 is not disposed; a wiring 52 disposed on the lower surface of the insulating layer 55 and electrically connected to the lower-side end of the through electrode 56; an insulating layer 59 covering the lower surface of a portion of the wiring 52, the portion where a bump(s) 91 is not formed, and the lower surface of a portion of the insulating layer 55, the portion where the wiring 52 is not disposed; and a conduit(s) 51 passing through the insulating layer 58, the insulating layer 54, the interposer 53, the insulating layer 55 and the insulating layer 59.

The wiring 52 is connected, via the through electrode 56 and the wiring 57, to a not-shown control unit relating to voltage application to the actuator 60.

The bonding substrate 20, the pressure chamber substrate 30, the spacer substrate 40 and the wiring substrate 50 are provided with conduits 22, 32, 41, 51, respectively, which communicate with the pressure chamber 31. The ink flow channel formed of the conduits 22, 32, 41, 51 is connected to an external ink supply/flow channel disposed above the wiring substrate 50.

The external ink supply/flow channel is disposed, for example, in a not-shown casing vertically arranged above the wiring substrates 50 of the head chips 2, and connected to a not-shown ink supply mechanism. The ink supplied to the ink supply/flow channel from the ink supply mechanism is supplied to each pressure chamber 31 through the ink supply/flow channel and the conduits 51, 41, 32, 22. The ink supplied to the pressure chamber 31 is discharged from the nozzle N by pressure applied to the ink in the pressure chamber 31 by the oscillation plate 33 oscillating according to the operation of the actuator 60.

In the above-described pressure chamber 31, the ink to be discharged from the nozzle N is stored. The actuator 60 applies the pressure to the pressure chamber 31 for discharging the ink from the nozzle N.

The actuator 60 is electrically connected to the wiring 52 disposed in the wiring substrate 50. More specifically, the actuator 60 is, for example, a quadrangular piezoelectric element having the upper surface and the lower surface along the XY plane, and provided with a first electrode 61 on the upper surface and a second electrode 62 on the lower surface.

The first electrode 61 is electrically connected, via the connecting part 90, to the wiring 52 disposed on the lower surface side of the wiring substrate 50.

The connecting part 90 is disposed so as to connect the first electrode 61 to the wiring 52 along the Z direction. The connecting part 90 has the bump 91 formed in the wiring substrate 50. More specifically, the bump 91 is formed, for example, by wire bonding using gold as a material, and formed on the lower surface of the wiring 52.

The wiring 52 is formed, for example, by patterning of conductive metal (e.g., Cr, Ti, Au) using photolithography or the like. For example, the wiring 52 is formed by patterning of Cr and then patterning of Au. Here, Cr or Ti is utilized as a closely-attached layer to Au.

To the lower end side of the bump 91, a conductive material 92 is applied. More specifically, the conductive material 92 is, for example, a conductive adhesive. The conductive adhesive is an adhesive mixed with conductive metal powder (e.g., silver powder, etc.), thereby having conductivity.

Thus, the connecting part 90 electrically connects the wiring substrate 50 to the actuator 60, with the bump 91 formed in the wiring substrate 50 and the conductive material 92 applied to the bump 91.

The second electrode 62 touches an electrode layer formed in the oscillation plate 33. The electrode layer formed in the oscillation plate 33 functions as an electrode which electrically connects the second electrode 62 to the control unit.

More specifically, the second electrode 62 is connected to the control unit, for example, via a not-shown wiring connected to the electrode layer formed in the oscillation plate 33. The electrode layer is formed, for example, by patterning of conductive metal (e.g., Cr, Ti, Au) in the oscillation plate using photolithography or the like. For example, the electrode layer is formed by patterning of Cr and then patterning of Au. Here, Cr or Ti is utilized as a closely-attached layer to Au.

The piezoelectric element acts as the actuator 60 under the control of the control unit by the first electrode 61 being connected to the control unit via the connecting part 90, the wiring 52, the through electrode 56 and the wiring 57, and also the second electrode 62 being connected to the control unit via the electrode layer formed in the oscillation plate 33.

In the nozzle substrate 10, the bonding substrate 20, the pressure chamber substrate 30, the spacer substrate 40 and the wiring substrate 50, the alignment marks M1, M2, M3, M4 and M5 are formed near the both ends of the respective substrates in the X direction in order to accurately align these substrates with one another when joining them to one another.

Each of the alignment marks M1 to M5 is a circular through hole passing through its corresponding substrate at a predetermined point on the XY plate thereof along the Z direction. The alignment marks M1 to M5 are formed to be concentric when viewed from the Z direction in the state in which the substrates are accurately aligned with one another each parallel to the XY plate and then joined.

As to the inner diameters of the alignment marks M1 to M5, the higher the alignment mark is located, the larger the set inner diameter is. That is, the inner diameters of the alignment marks M1 to M5 satisfy "M1<M2<M3<M4<M5".

Such head chips 2 are aligned with the supporting substrate 3 (position reference substrate) having alignment marks M6, the inner diameter of which is larger than that of the alignment marks M5 (FIG. 3).

The substrates are stacked with fine position adjustment such that the alignment marks M1 to M6 are superposed, and accordingly the relative position of the butting parts 4, with which the supporting substrate 3 (position reference substrate) is provided, with respect to the nozzles N become highly accurate.

[Configuration of Inkjet Head Module]

Figure 5:
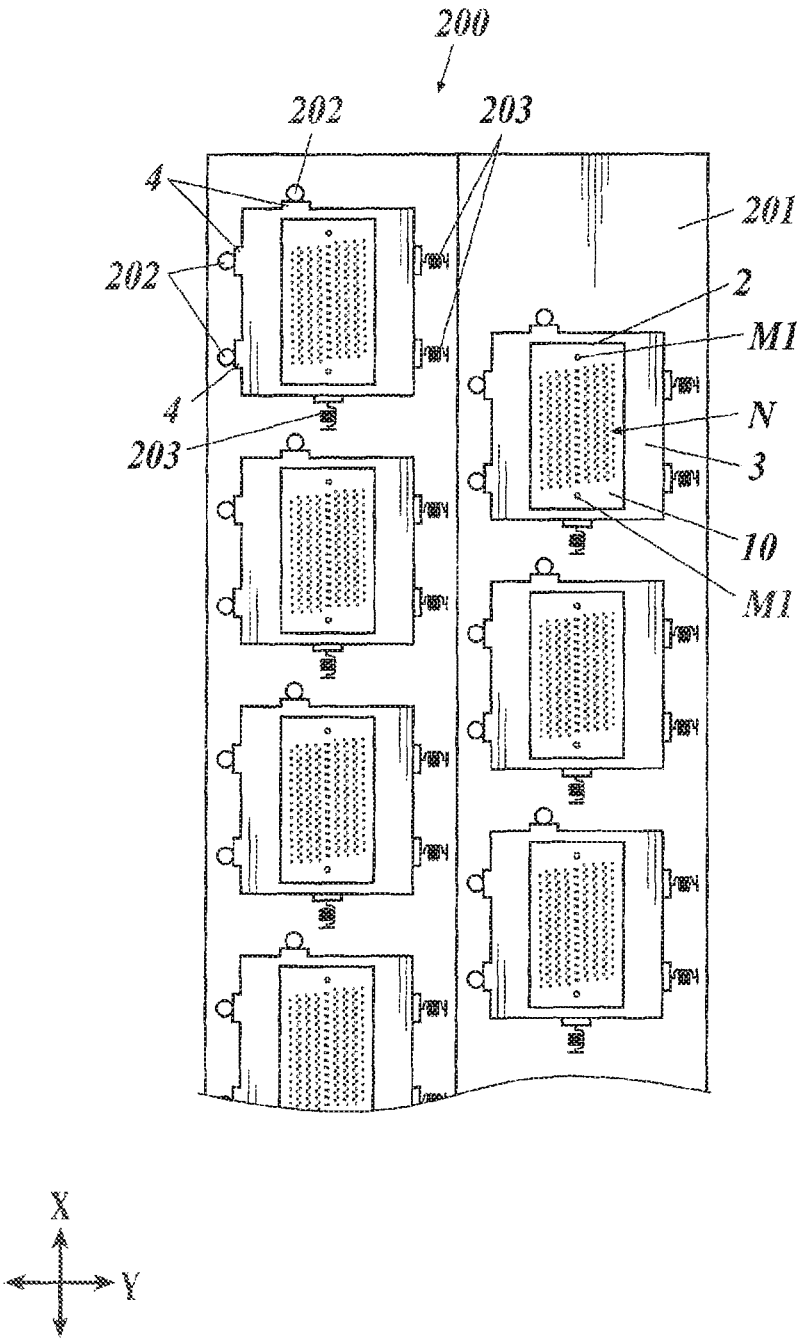
FIG. 5 is a bottom view showing the configuration of an inkjet head module.

Next, the configuration of the inkjet head module is explained with reference to FIG. 5.

Hereinafter, explanation is made, as a representative example, about the inkjet head module 200, which is one of the inkjet head modules 200, 210, 220, 230 (FIG. 1) arranged parallel in the inkjet printer of the embodiment. FIG. 5 is a bottom view of the inkjet head module 200 and shows the side which faces the recording medium K.

The inkjet head module 200 has mounting members 201 having opening parts in the bottom. In the opening parts of the mounting members 201, the inkjet heads 1 are mounted and fixed such that the surfaces of the nozzle substrates 10 are exposed from the opening parts.

In each mounting member 201, the inkjet heads 1 are mounted and fixed in the state of being arranged one dimensionally in the length direction (X direction). The mounting members 201 are disposed to be two columns parallel in the conveying direction (Y direction), and the inkjet heads 1 are mounted and fixed in their respective opening parts in a positional relationship of houndstooth check arrangement as a whole.

The inkjet heads 1 are mounted in the mounting members 201 by butting the butting parts 4, with which the supporting substrates 3 of the inkjet heads 1 is provided, against the butted parts 202, with which the mounting members 201 is provided.

The inkjet head module 200 includes elastic members 203 as a biasing mechanism which biases the butting parts 4 toward a direction in which the butting parts 4 are pressed. The inkjet heads 1 are pressed by the elastic members 203 toward a direction in which the butting parts 4 are butted, and thereby can be stably fixed to the mounting members 201.

[Modification of Inkjet Head Module]

Figure 6:
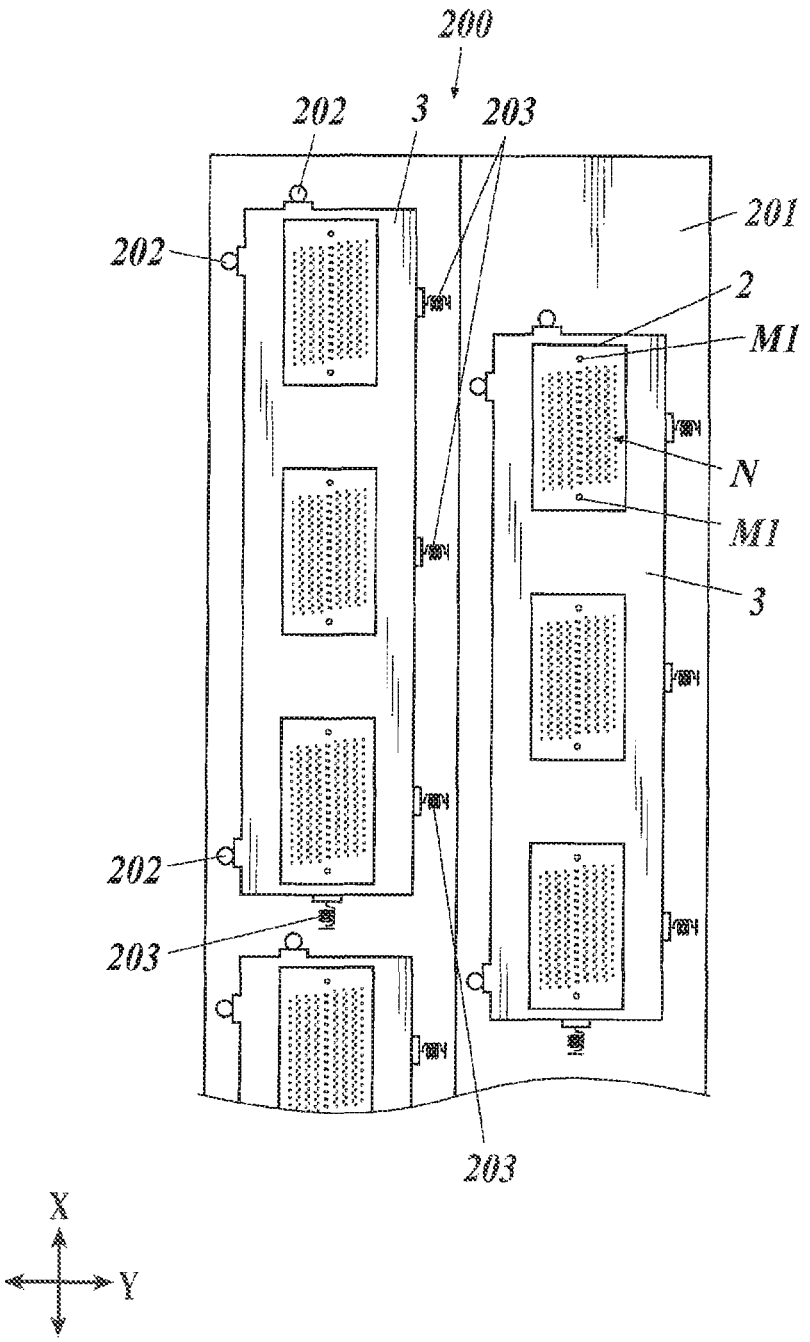
FIG. 6 is a bottom view showing the configuration of a modification of the inkjet head module.

Next, the configuration of a modification of the inkjet head module 200 is explained with reference to FIG. 6. Explanation about the same components as those of the embodiment is not repeated here.

In the modification, two or more (e.g., three) inkjet heads 1 arranged in the one-dimensional direction (X direction) are supported by a shared supporting substrate 3, and the inkjet heads 1 are mounted and fixed in the opening parts of the mounting member 201 by the butting parts 4 with which the shared supporting substrate 3 is provided.

The contour part of the XY plane of the shared supporting substrate 3 is provided with the butting parts 4 at three points in total, two points along the X direction and one point along the Y direction. When the inkjet heads 1 are mounted on the mounting member 201, the butting parts 4 are pressed by the elastic members 203 as the biasing mechanism against the butted parts 202, with which the mounting member 201 is provided, toward the direction in which the butting parts 4 are butted, thereby being butted against and fixed to the butted parts 202.

Thus-configured inkjet head module 200 increases the number of inkjet heads replaceable at once and hence improves usability.

CONCLUSION

As described above, the present invention can position the nozzles with respect to the mounting member(s) 201 with a high degree of accuracy, with the butting parts 4, with which the supporting substrate 3 (position reference substrate) stacked on the head chip 2 with a high degree of accuracy is provided. Hence, even if the inkjet head(s) 1 in which the nozzles N are densely arranged is used, reduction in quality of formed images can be prevented.

Further, the position reference substrate disposed in the inkjet head 1 can be fixed by the simple method, namely, by being butted against the butted parts 202, with which the mounting member 201 is provided. This is a fixing method having high maintainability.

[Others]

The embodiment(s) or the like of the present invention disclosed herein should be considered to be no limitations but examples in all the aspects. The scope of the present invention is not limited to the above detailed description but shown by the scope of claims, and is intended to include equivalents to the scope of claims and any change within the scope thereof.

For example, although, in the above, the butting parts 4, with which the supporting substrate 3 (position reference substrate) is provided, are rectangular, the shape can be changed as long as it allows the butting parts 4 to be butted against the butted parts.

Further, although, in the above, the butting parts 4 are disposed at three points of the supporting substrate 3 in total, two points in the X direction and one point in the Y direction, changes can be made in this aspect as long as at least two points of the supporting substrate 3 can be butted against.

Further, although, in the embodiment, the supporting substrate 3 provided with the butting parts 4 is used as the position reference substrate, any of the substrates disposed between the nozzle substrate and the ink chamber 5 can be used as the position reference substrate. For example, the spacer substrate 40 may be used as the position reference substrate. In this case, the contour part of the spacer substrate 40 is provided with the butting parts 4.

In the case where the spacer substrate 40 is used as the position reference substrate, because the substrate closer to the nozzle substrate 10 as compared with the supporting substrate 3, which is the position reference substrate of the embodiment, is used as the position reference substrate, the number of substrates between the position reference substrate and the nozzle substrate is smaller than that in the embodiment. This has an advantage that position accuracy of the butting parts 4 with respect to the nozzles N can be more easily enhanced.

In the case where the spacer substrate 40 is used as the position reference substrate as described above, it is preferable to use 42 alloy as its base material. 42 alloy is very useful because it has high ink resistance and excellent heat resistance and also has strength sufficient to be used as the position reference substrate.

In the case where the spacer substrate 40 is used as the position reference substrate as described above, it is unnecessary to form all the alignment marks M1 to M6 in the substrates of the head chip 2 and the supporting substrate 3 and stack all the substrates with a high degree of accuracy. More specifically, it is only necessary to form the alignment marks in the substrates on the lower side of the spacer substrate 40, which serves as the position reference substrate, in the X direction including the spacer substrate 40 and stack these substrates with a high degree of accuracy. That is, as long as position accuracy of the position reference substrate with respect to the nozzles N is high, it is not essential that the substrates above the position reference substrate are stacked with a high degree of accuracy.

Further, the alignment marks M1 to M6 are not limited to being circular, and hence changes can be made in this aspect. It is, however, desired that the alignment marks M1 to M6 have similar shapes.

Further, although, in the above, the sizes of the alignment marks M1 to M6 satisfy "M1<M2<M3<M4<M5<M6", this size relationship may be reversed, namely, may be "M6<M5<M4<M3<M2<M1".

Further, for example, a plurality of substrates may be used as the position reference substrate. If a plurality of substrates is used as the position reference substrate, this contributes to hardly causing position shift in the Z direction (up-down direction) in addition to hardly causing two-dimensional position shift along the XY plane.

Further, instead of one of the substrates doubling as the position reference substrate, a separate position reference substrate may be provided. More specifically, for example, a separate position reference substrate may be disposed between the wiring substrate 50 and the supporting substrate 3, and used only for the purpose of the above-described butting and fixing.

Further, as a method for fixing the inkjet heads 1 in the inkjet head module 200, adjustment screws or the like may also be provided for fine adjustment.

Further, although, in the above, ink is discharged by using the piezoelectric elements as the actuators 60, no particular limitation is set in this aspect as long as a mechanism to discharge ink is provided. For example, a thermal method (thermoelectric transducers) may be used.

Further, although, in the above, the elastic members 203 are provided as the biasing mechanism in order to stably fix the butting parts 4 to the butted parts 202, the biasing mechanism is not limited to the elastic members 203, and hence changes can be made in this aspect as long as the butting parts 4 can be stably fixed to the butted parts 202.

Further, the scope of the present invention is not limited to the above and hence may be modified and changed in design in various aspects without departing from the spirit of the present invention.

INDUSTRIAL APPLICABILITY

The present invention is applicable to an inkjet head, an inkjet head module, and an inkjet printer.

DESCRIPTION OF REFERENCE NUMERALS

1 Inkjet Head
2 Head Chip
3 Supporting Substrate (Position Reference Substrate)
4 Butting Part
5 Ink Chamber
10 Nozzle Substrate

100 Inkjet Printer
200 Inkjet Head Module
201 Mounting Member
202 Butted Part
203 Elastic Member (Biasing Mechanism)
N Nozzle
M1 to M6 Alignment Mark

The invention claimed is:

1. An inkjet head comprising:

a head chip having a nozzle substrate provided with nozzles which discharge ink; and an ink chamber which is located over the head chip and in which the ink to be supplied to the nozzles is stored, and a position reference substrate interposed between the nozzle substrate and the ink chamber, the nozzle substrate and the ink chamber being joined to and supported by the position reference substrate wherein the inkjet head is mounted on a mounting member and the position reference substrate is provided with butting parts which are butted against the mounting member to position the inkjet head relative to the mounting member when the inkjet head is mounted on the mounting member, and the position reference substrate supports the nozzle substrate and the ink chamber relative to the mounting member.

2. The inkjet head according to claim 1, wherein the head chip is constituted of a stack of substrates, and the position reference substrate is an additional layer stacked on the stack of substrates.

3. The inkjet head according to claim 1, wherein the head chip and the position reference substrate each have a coefficient of linear expansion of $1.2\times10^{-6}$ [/° C.] or more and $8.5\times10^{-6}$ [/° C.] or less.

4. The inkjet head according to claim 1, wherein the position reference substrate is formed of 42 alloy.

5. The inkjet head according to claim 1, wherein the head chip and the position reference substrate have alignment marks, and the head chip and the position reference substrate are stacked such that the alignment marks are superposed.

6. An inkjet head module comprising:

the inkjet head according to claim 1; and the mounting member which has an opening part and on which the head chip is mounted such that the nozzles are exposed from the opening part to face a recording medium, wherein the butting parts are fixed by being butted against butted parts with which the mounting member is provided.

7. The inkjet head module according to claim 6, wherein opening parts, each being the opening part, are arranged one dimensionally or two dimensionally, and inkjet heads, each being the inkjet head, are arranged to correspond to the opening parts.

8. An inkjet printer comprising the inkjet head module according to claim 6.

9. The inkjet printer according to claim 8, comprising a biasing mechanism which, in order that the butting parts are butted, biases the butting parts toward a direction in which the butting parts are pressed.

10. An inkjet head module comprising:

the inkjet head according to claim 1; and the mounting member which has an opening part and on which the head chip is mounted such that the nozzles are exposed from the opening part to face a recording medium, wherein the butting parts are fixed by being butted against butted parts with which the mounting member is provided, opening parts, each being the opening part, are arranged one dimensionally or two dimensionally, inkjet heads, each being the inkjet head, are arranged to correspond to the opening parts, and head chips, each being the head chip, of the inkjet heads are supported by the supporting substrate being shared.

11. The inkjet head according to claim 1, further comprising a connecting substrate supplying electricity to the head chip, the connecting substrate disposed between the head chip and the position reference substrate.

* * * * *